United States Patent [19]

Medovar et al.

[11] 4,027,092

[45] May 31, 1977

[54] ELECTRODE HOLDER OF A MULTIELECTRODE FURNACE

[76] Inventors: Boris Izrailevich Medovar, ulitsa A.Barbjusa, 22/26, kv. 109; Ilya Iosifovich Kumysh, Vozdukhoflotsky proezd, 42, kv. 51; Georgy Alexandrovich Boiko, Vladimiro-Lybedskaya ulitsa, 16, kv. 106; Stanislav Vitalievich Grodzitsky, ulitsa Matejuka, 5, kv. 110, all of Kiev; Nikolai Vasilievich Arkhipov, ulitsa Melentievoi, 7, kv. 54; Anatoly Nikolaevich Skoropupov, ulitsa Melentievoi, 7, kv. 53, both of Petrozavodsk, all of U.S.S.R.

[22] Filed: Feb. 17, 1976

[21] Appl. No.: 658,704

[52] U.S. Cl. ..... 13/15

[51] Int. Cl.[2] ..... H05B 7/101

[58] Field of Search ..... 13/14, 15, 16, 17

[56] References Cited

UNITED STATES PATENTS

| | | | |
|---|---|---|---|
| 881,519 | 3/1908 | Wilson | 13/16 X |
| 3,697,660 | 10/1972 | Frolov et al. | 13/15 X |
| 3,781,935 | 1/1974 | Medovar et al. | 13/14 X |
| 3,832,476 | 8/1974 | Medovar et al. | 13/16 X |
| 3,839,591 | 10/1974 | Paton | 13/16 X |

*Primary Examiner*—R. N. Envall, Jr.

*Attorney, Agent, or Firm*—Lackenbach, Lilling & Siegel

[57] ABSTRACT

An electrode holder of a multielectrode furnace comprises at least two parts of a support plate, which are insulated electrically from each other. On each part of the support plate some holes are used for fastening the consumable electrodes, while other holes are used for passing the consumable electrodes. The number of holes in each part of the support plate is equal to the number of the consumable electrodes. At least two of said holes are used for fastening the consumable electrodes and have the shape necessary for fastening the inventory heads of the consumable electrodes. The other holes of the support plate are used for passing the consumable electrodes. The parts of the support plate are installed above each other in such a way that the holes for fastening the consumable electrodes of one part of the support plate should be located coaxially above the holes for passing the consumable electrodes of the other part of the support plate.

The parts of the support plate are made of a conductive material and are used for feeding the power to the consumable electrodes. Each part of the support plate with the consumable electrodes arranged thereon is connected to the corresponding lead of a power supply source.

7 Claims, 10 Drawing Figures

ELECTRODE HOLDER OF A MULTIELECTRODE FURNACE

The present invention relates to electrode holders of a multielectrode furnace.

The electrode holder according to the invention can be used most efficiently in special furnaces for electroslag remelting of metals.

In addition, the electrode holder according to the invention can be used in the known electric arc, electric vacuum and plasma-arc furnaces.

Known in the art are multielectrode furnaces wherein consumbale electrodes are fed simultaneously to the slag bath. The electrode holders of these known furnaces comprise a common support platform, which is provided with holes through which the consumable electrodes pass, and current supply jaws installed thereon. Fastened in these jaws are consumable electrodes insulated electrically from each other.

For connecting each jaw to the corresponding phase of the power supply source and for connecting the jaws to each other according to a required diagram use is made of a system of cooled hollow copper pipes, copper buses and special cable mains.

The current supply jaws are usually massive copper parts having cavities for a coolant.

When arranging in the slag bath a number of consumable electrodes (six or more) the electrodes are mounted along the circumference, whereas it is desirable that the distance between the consumable electrodes be commensurable with the diameter of the consumable electrodes.

Under this condition the main current flows between the adjacent electrodes connected to the different leads of the power supply source. Hence an intensive heating of the slag bath and a uniform melting of the consumable electrodes take place.

When the distance between the consumable electrodes is increased to values not commensurable with the diameters thereof, the main current begins flowing along the walls of the mold wherein the slag bath is maintained, non-uniform heating of the slag bath occurs and non-uniform remelting of the consumbale electrodes takes place, thus worsening the refining properties of the slag bath, causing an instability of the electroslag process and, therefore, worsening the quality of the metal obtained in the electroslag remelting process.

The necessity of arranging the consumable electrodes in the slag bath along the circumference at distances commensurable with their diameter causes the necessity of also installing the current supply jaws at the same distances. However it is very difficult to arrange the jaws this way in view of the great sizes of the jaws and due to the intricacy of the power supply mains.

To enhance the space wherein the current supply jaws can be arranged, the diameter of the consumable electrode portion to be fastened, called inventory head, thereof or the diameter along which the consumable electrodes are fastened is increased, but in this case the inventory head of the consumable electrode has an intricate L-shaped form. Both cases cause additional power losses due to the change of the area of the inventory head section.

In addition, the use of inventory heads having an intricate shape causes great difficulties when mounting the consumable electrodes on the electrode holder and when replacing them.

The current supply jaws installed on the support plate are such massive copper parts that they do not permit arranging the required number of them along the circumference of the small diameter along which the consumable electrodes are located, thus causing difficulties in feeding the power supply to the current supply jaws in view of the lack of free space of the support plate which may be used for arranging current supply hollow copper pipes, buses and cable mains as well as in the operations for replacing the consumable electrodes in the current supply jaws.

It is an object of the present invention to eliminate said disadvantages.

It is another object of the present invention to simplify the operations for replacing the consumable electrodes in the multielectrode holder and to simplify the design of the electrode holder.

The main object of the present invention is to provide an electrode holder of the multielectrode furnace wherein the consumable electrodes are arranged along the circumference as proximate as possible to each other, thus simplifying the arrangement of the consumable electrodes in the electrode holder and simplifying the power supply thereto.

These and other objects are accomplished by providing an electrode holder of the multielectrode furnace, comprising a support plate with through holes whose number is equal to that of consumable electrodes, said support plate being made of at least two parts secured to each other and insulated electrically from each other each part having at least two holes of the shape necessary for fastening the inventory heads of the consumable electrodes, while through the other holes the consumable electrodes pass, said parts of the support plate being arranged above each other in such a way that the holes for fastening the inventory heads of the consumable electrodes of one part of the support plate are located coaxially in front of the holes through which the consumable electrodes of the other part of the support plate pass, and each part of the support plate being made of a conductive material, being connected to the corresponding lead of a power supply source and being used for supplying the current to the consumable electrodes secured thereon.

When the support plate is made of two parts, the consumable electrodes connected to one lead of the power supply source only are installed on each part of the support plate. Hence, it is not necessary to use the current supply jaws on the support plate while each part of the support plate is used as power supply leads, thus eliminating the necessity of using hollow copper pipes, buses and cable mains for supplying the current to the consumable electrodes and simplifying the operations for replacing the consumable electrodes in the electrode holder.

It is expedient that a gap between the inner wall of the hole through which the consumable electrodes pass and the outer surface of the consumable electrode should be such that an electric break-through between the consumable electrode and the part of the support plate through which the consumable electrode passes should be impossible.

It is desirable that the parts of the support plate should be hollow for supplying thereinto a coolant. Due to this embodiment of the parts of the support plate, the coolant penetrating into the cavity of each part of the support plate washes directly the places wherein the inventory heads of the consumable electrodes are fastened. Hence it is necessary to use the pipelines for supplying the coolant to each current supply jaw.

It is expedient thst the support plate should be made of copper. This feature avoids great power loses when supplying the current to the consumable electrodes.

The specific features and advantages of the present invention will appear more completely from the following detailed description of a preferred embodiment thereof with due reference to the accompanying drawings wherein.

Figure 1:
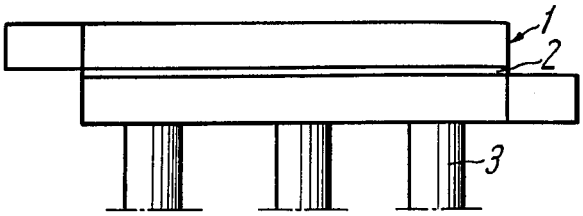
FIG. 1 shows a side elevational view of an electrode holder of the four-electrode two-phase furnace, according to the invention.
Figure 2:
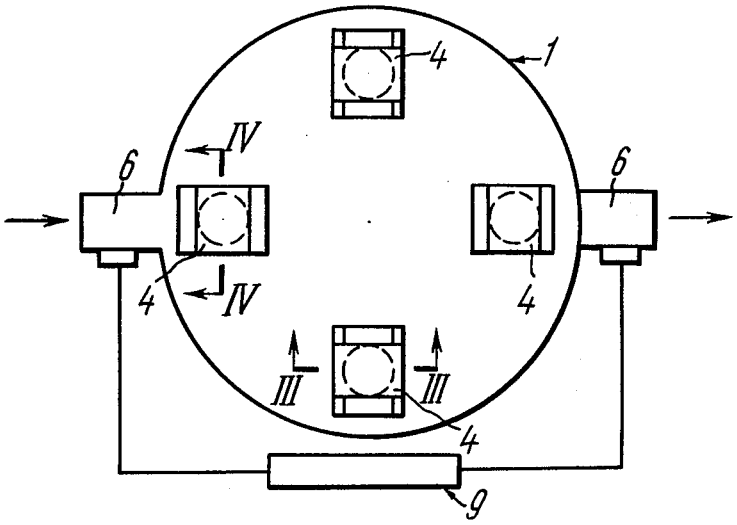
FIG. 2 shows a top view of an electrode holder of the four-electrode two-phase furnace, according to the invention.
Figure 3:
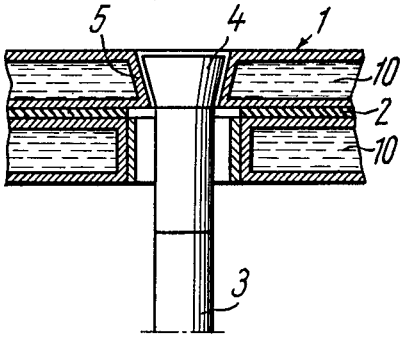
FIG. 3 is a III—III of FIG. 2 of the electrode holder of the four-electrode two-phase furnace.
Figure 4:
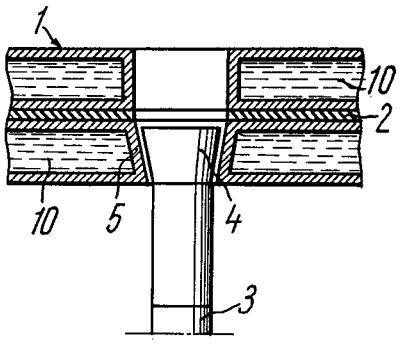
FIG. 4 is a section IV—IV of FIG. 2 of the electrode holder of the four electrode two-phase furnace.

According to the invention, an electrode holder in a four-electrode electroslag furnace, used, for example, in a two-phase electrode-to-electrode supply circuit, is a support plate 1 made of two parts (FIGS. 1 and 2). The parts of the support plate 1 are secured to each other and are insulated electrically from each other by an insulating gasket 2. Each part of the support plate is provided with holes for fastening and passing the consumable electrodes 3. Said holes are arranged along the circumference and their number is equal to the number of consumable electrodes. Each consumable electrode 3 has a portion fastened in the support plate 1 which is called the inventory head 4 (FIGS. 2, 3 and 4) of the consumable electrode. The inventory head 4 is made in the form of a truncated pyramid or a truncated cone and its narrow portion is connected to the body of the consumable electrode 3. The enlarged portion of the inventory head 4 is used for fastening the consumable electrode 3 in the parts of the support plate 1.

Two holes of all the holes in each part of the support plate are used for fastening the inventory heads 4 of the consumable electrodes 3. For this purpose the inner surface of these holes is made in the form of a truncated pyramid whose small base is down. The inner surfaces of these holes form contact surfaces 5 used for supplying the power to the consumable electrodes (FIGS. 3 and 4) and at the same time are used as devices for fastening the inventory heads 4 which reset on these contact surfaces 5.

The other holes of each part of the support plate 1 are used for passing the consumable electrodes 3, having a rectangular shape and allow passage of the inventory heads 4 of the consumable electrodes 3.

An annular gap precluding an electric break-through between the consumable electrode 3 and the part of the support plate 1 through which said consumable electrode passes should be between the inner surface of the hole through which the consumable electrode 3 passes and the outer surface of the consumable electrode 3. This gap is usually not less than 10 mm. This gap according to the invention allows the current flow through the consumable electrodes without any electric break-through within a range from 5,000 to 15,000 A which is usual during the electroslag remelting of the consumable electrodes. When the current flowing through the consumable electrodes 3 is increased above the range disclosed above, the annular gap value should be increased respectively.

The parts of the support plate 1 are installed and connected in a packet in such a way that the holes of one part of the support plate used for fastening the consumable electrodes 3 are arranged coaxially in front of the holes of the other part of the support plate through which the consumable electrodes 3 pass.

Figure 5:
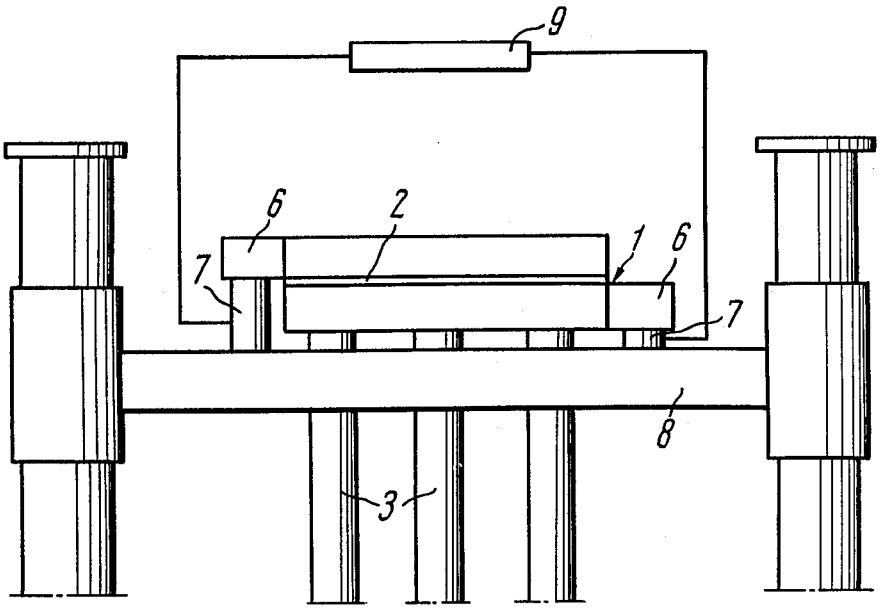
FIG. 5 shows an arrangement of the electrode holder on the platform of the four-electrode furnace.
Figure 7:
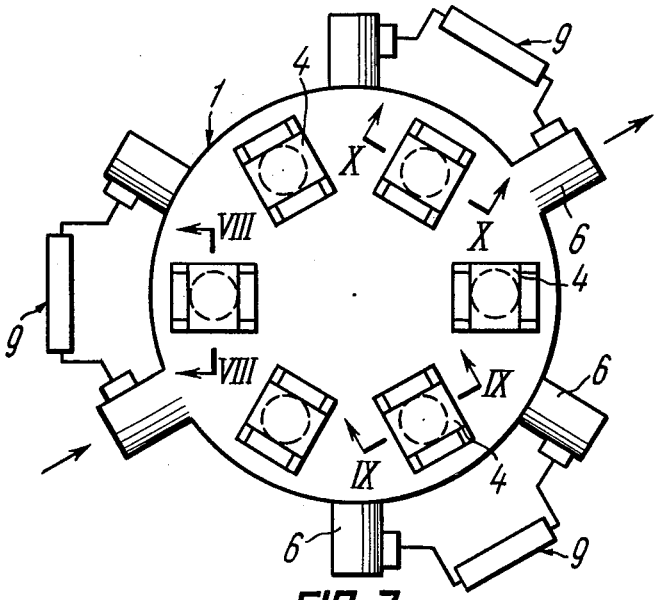
FIG. 7 shows a top view of the electrode holder of the six-electrode three-phase furnace, according to the invention.
Figure 8:
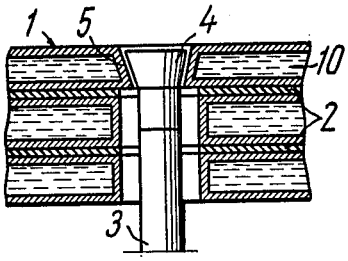
FIG. 8 is a VII—VII of FIG. 7 of the electrode holder of the six-electrodes three-phase furnace, according to the invention.
Figure 9:
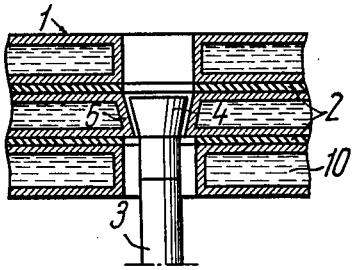
FIG. 9 is a IX—IX of FIG. 7 of the electrode holder of the six-electrode three-phase furnace, according to the invention.
Figure 10:
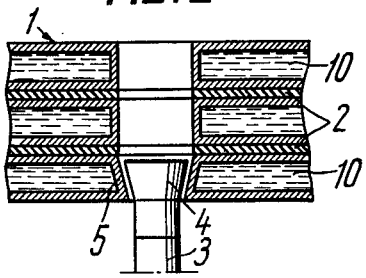
FIG. 10 is a X—X of FIG. 7 of the electrode holder of the six-electrode three-phase furnace, according to the invention.

Each part of the support plate 1 has a contact platform 6 which is a portion of the body of this part of the support plate 1 and is used for feeding to this part of the support plate 1 the current from a lead 7 (FIG. 5) located on a platform 8 for installing the electrode holder of the electroslag furnace. The leads 7, arranged on the platform 8 of the electroslag furnace for installing the electrode holder, by using hollow copper cooled pipes, buses and cable mains (not shown) are connected to a power supply source 9 (FIGS. 2,5,7).

Figure 6:
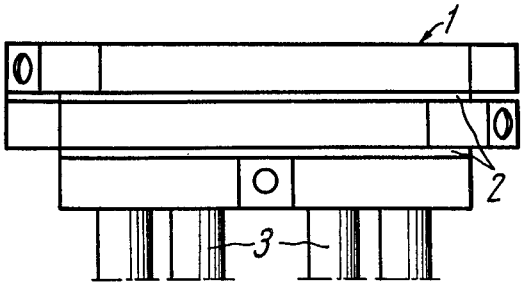
FIG. 6 shows a side elevational view of the electrode holder of the six-electrode three-phase furnace, according to the invention.

The electrode holder used in the three-phase power supply circuit, in contrast with the just described embodiment, has a support plate 1 comprising three parts (FIGS. 6,7) separated by insulating gaskets 2 from each other and assembled in a packet.

Each part of the support plate 1 is connected to the respective phase of the power supply source 9. Thus, each part of the support plate 1 accommodates the consumable electrodes 3 connected to one lead of the power supply source 9 only. Hence, the total amount of current supply jaws on each part of the support plate is reduced, while the parts of the support plate 1 are used as leads, thus eliminating the necessity of using hollow cooled copper pipes, buses and cable mains for feeding the power to the consumable electrodes and simplifying the operations for replacing the consumable electrodes in the electrode holder.

The parts of the support plate 1 (FIGS. 3,4,7,8,9) of the electrode holder of the multielectrode furnace are hollow so that a coolant 10 may be supplied thereinto.

Thus, each part of the support plate 1 has a cavity containing a coolant 10 supplied thereinto and a contact surfaces 5 which are elements of the bodies of the parts of the support plate 1. Therefore the coolant 10 fed into the cavities of each part of the support plates 1 washes directly the contact surfaces 5.

Hence it is not necessary to use the pipelines for supplying the coolant to each contact surface.

Each part of the support plate 1 is made of copper, thus avoiding great electric energy losses when feeding the power to the consumable electrodes 3. The electrode holder is prepared for the operation as follows:

The electrode holder is mounted on a special bench whereon the consumable electodes 3 with the welded inventory heads 4 are sunk downwards into the holes of the electrode holder. Some of the electrodes are maintained by the contact surfaces 5 of the top part of the support plate, while other electrodes are maintained by the contact surface 5 of the bottom part of the support plate.

Then the electrode holder with the consumable electrodes 3 installed therein is placed on the platform 8 of the furnace (FIG. 5) for installing the electrode holder in such a way that the contact platforms 6 (FIGS. 2,5,7) of the support plates 1 are placed on the leads 7 of the platform 8 of the furnace for installing the electrode holder.

It is also possible to install the electrode holder on the platform of the furnace for installing the electrode holder without consumable electrodes and thereafter the consumable electrodes 3 are placed into the electrode holder.

The parts of the support plates 1 are coupled to a coolant source (not shown). When the power supply is put on, the current is applied from the cable mains, the bus lead and the hollow copper cooled pipes to the leads 7 of the platform 8 whereon the electrode holder is installed. Then the current is applied to the contact platforms 6 of the support plates 1 and along the support plates 1 to the contact surfaces 5 and to the inventory heads 4 of the consumable electrodes 3. Then the process of the electroslag remelting begins and is carried out in a known method.

What we claim is:

1. An electrode holder of a multielectrode furnace for holding consumable electrodes having an enlarged inventory head, comprising: a support plate with through holes, the number of holes corresponding to the number of consumable electrodes, said support plate being made from at least two parts insulated electrically from each other, each part of the support plate having at least two holes of a shape necessary for fastening said inventory heads of said consumable electrodes, the other holes being used for passing said consumable electrodes, said parts of the support plate being arranged above each other in such a way that said through holes, of one of said parts of the support plate, used for fastening said inventory heads of said consumable electrodes are located coaxially in front of said holes, of the other part of the support plate, through which said consumable electrodes pass, each part of said support plate being made of a conductive material, being connected to a corresponding lead of a power supply source and being used for feeding a current to the consumable electrodes arranged thereon.

2. An electrode holder of a multielectrode furnace as claimed in claim 1, wherein there is defined between the inner walls of said holes, of each part of the support plate through which the consumable electrodes pass, and the outer surface of the consumable electrodes an annular gap precluding an electric break-through between said consumable electrodes and said part of the support plate through which they pass.

3. An electrode holder of a multielectrode furnace as claimed in claim 1, wherein said parts of the support plates are made of copper.

4. An electrode holder of a multielectrode furnace as claimed in claim 1, wherein said parts of the support plate are hollow so that a coolant can be supplied thereto.

5. An electrode holder of a multielectrode furnace as claimed in claim 2, wherein said parts of the support plate are made of copper.

6. An electrode holder of a multielectrode furnace as claimed in claim 2, wherein said parts of the support plate are hollow so that a coolant can be supplied thereto.

7. An electrode holder of a multielectrode furnace as claimed in claim 3, wherein said parts of the support plate are hollow so that a coolant can be supplied thereto.

* * * * *